US010655361B2

(12) United States Patent
Krieger et al.

(10) Patent No.: US 10,655,361 B2
(45) Date of Patent: May 19, 2020

(54) LOCK INSERT FOR A CYLINDER LOCK

(71) Applicant: Siemens Aktiengesellschaft, München (DE)

(72) Inventors: Harald Krieger, Neuhaus (DE); Ekkehard Plechinger, Roeckersbuehl (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 578 days.

(21) Appl. No.: 14/773,812

(22) PCT Filed: Feb. 18, 2014

(86) PCT No.: PCT/EP2014/053081

§ 371 (c)(1),
(2) Date: Sep. 9, 2015

(87) PCT Pub. No.: WO2014/187579

PCT Pub. Date: Nov. 27, 2014

(65) Prior Publication Data

US 2016/0032617 A1 Feb. 4, 2016

(30) Foreign Application Priority Data

May 22, 2013 (DE) ..... 10 2013 209 399

(51) Int. Cl.
*E05B 9/04* (2006.01)
*H01H 27/06* (2006.01)
(Continued)

(52) U.S. Cl.
CPC ..... *E05B 9/04* (2013.01); *E05B 9/084* (2013.01); *E05B 65/00* (2013.01); *H01H 27/06* (2013.01)

(58) Field of Classification Search
CPC ..... E05B 9/04; E05B 9/084; E05B 65/00; H01H 27/06
(Continued)

(56) References Cited

U.S. PATENT DOCUMENTS 2,093,038 A * 9/1937 Douglas ..... B60K 37/06 248/27.3
2,424,757 A * 7/1947 Klumpp, Jr. ..... F16B 21/086 16/2.2
(Continued)

FOREIGN PATENT DOCUMENTS

CN 86204352 U 9/1987
DE 2512261 A1 9/1976
(Continued)

OTHER PUBLICATIONS

Chinese Office Action dated Oct. 17, 2018.
(Continued)

*Primary Examiner* — Suzanne L Barrett
(74) *Attorney, Agent, or Firm* — Harness, Dickey & Pierce, P.L.C.

(57) ABSTRACT

A lock insert for a cylinder lock is disclosed for locking an electric switch, including a main part with an opening for receiving the cylinder lock. In an embodiment, the inner wall of the opening is designed to at least partially contact an outer wall of the cylinder lock, and in the inner wall at least one slot is formed to allow freedom of radial movement of locking elements in the cylinder lock, the positions of which correspond to a locked position of the cylinder lock.

20 Claims, 4 Drawing Sheets

(51) Int. Cl.
*E05B 9/08* (2006.01)
*E05B 65/00* (2006.01)

(58) Field of Classification Search
USPC ..... 70/370, 492, 369, 377
See application file for complete search history.

(56) References Cited

U.S. PATENT DOCUMENTS 2,519,758 A * 8/1950 Heidman, Jr. ..... H01H 27/06 200/4
2,558,852 A * 7/1951 Jacobi ..... B60R 25/04 248/27.3
2,580,548 A * 1/1952 Jacobi ..... E05B 9/084 70/370
2,745,275 A * 5/1956 Jacobi ..... G01D 11/305 248/27.1
2,803,716 A 8/1957 Nolden et al.
3,059,069 A 10/1962 Sedley
3,079,581 A * 2/1963 Klumpp, Jr. ..... H01R 9/16 174/153 G
3,190,092 A * 6/1965 Patriquin ..... E05B 9/04 248/27.1
3,270,151 A * 8/1966 Godette ..... H01H 27/06 200/43.08
3,485,969 A 12/1969 Millen
3,503,233 A * 3/1970 Armstrong ..... E05B 9/084 70/370
3,604,230 A * 9/1971 Tixier ..... E05B 1/0038 292/DIG. 37
4,264,792 A 4/1981 Gillette
4,363,230 A * 12/1982 Lipschutz ..... E05B 9/086 70/370
4,394,551 A * 7/1983 Scherbing ..... H01H 27/06 200/293
4,527,024 A * 7/1985 Lai ..... H01H 27/06 200/11 C
4,890,467 A 1/1990 Krause et al.
4,910,982 A * 3/1990 Dana ..... E05B 9/08 70/370
4,987,756 A * 1/1991 Fancher ..... B60R 25/02126 70/186
5,249,443 A * 10/1993 Anderson ..... E05B 9/084 70/123
5,251,467 A * 10/1993 Anderson ..... E05B 9/084 411/508
5,435,159 A * 7/1995 Ramsauer ..... E05B 9/084 70/370
5,479,800 A * 1/1996 Myers ..... E05B 15/1635 70/365
5,669,731 A * 9/1997 Hironaka ..... F16B 21/06 24/297
6,161,404 A * 12/2000 Westwinkel ..... E05B 9/084 70/370
6,508,092 B1 * 1/2003 Laabs ..... E05B 9/084 24/297
6,966,206 B2 * 11/2005 Masseth, Jr. ..... E05B 9/084 70/370
7,340,928 B2 * 3/2008 Hoffman ..... E05B 9/084 70/370
D680,416 S * 4/2013 Dalton ..... E05B 9/04 D8/330
9,428,936 B2 * 8/2016 Fenayon ..... E05B 77/44

FOREIGN PATENT DOCUMENTS

DE 2818479 A1 12/1978
DE 2919657 A1 11/1980
DE 1151048 B 7/1983
DE 3537252 A1 4/1987
DE 9012267 U1 12/1991
DE 4442284 C1 * 1/1996 ..... H01H 19/03
DE 202007015281 U1 3/2009
EP 2056319 A2 5/2009
EP 2056319 A3 4/2013

OTHER PUBLICATIONS

International Search Report dated Jul. 31, 2014.
German Office Action dated Oct. 24, 2014.
International Search Report PCT/ISA/210 for International Application No. PCT/EP2014/053081 dated Jul. 24, 2014.
Written Opinion of the International Searching Authority PCT/ISA/237 for International Application No. PCT/EP2014/053081 dated Jul. 24, 2014.
Indian Office Action dated Dec. 28, 2018 for corresponding Indian Application No. 2770/KOLNP/2015.

* cited by examiner

LOCK INSERT FOR A CYLINDER LOCK

PRIORITY STATEMENT

This application is the national phase under 35 U.S.C. § 371 of PCT International Application No. PCT/EP2014/053081 which has an International filing date of Feb. 18, 2014, which designated the United States of America and which claims priority to German patent application number DE 10201309399.3 filed May 22, 2013, the entire contents of which are hereby incorporated herein by reference.

FIELD

At least one embodiment of the present invention generally relates to a lock insert for a cylinder lock for locking an electric switch, to a sales unit comprising at least two lock inserts, and/or to a lock device for locking an electric switch.

BACKGROUND

It is known in principle that electric switches, in particular power switches, are intended to be designed such that they can be shut off. The electric switches can be designed, for example, for operating machines or electric current circuits in buildings.

It may be important here for the electric switch to be able to shut off. For example, if maintenance work is intended to be carried out to the corresponding current network, it is of crucial relevance in terms of safety that the electric switch can be shut off in the off position thereof.

At the same time, there are use situations in which a plurality of electric switches are arranged next to one another. In this case, it may be relevant, expressly with regard to safety, for only a single electric switch ever to be switched on at one time.

In order to solve these problems, it is customary, in the case of known electric switches, to provide a cylinder lock which ensures that the respective electric switch is locked. For this purpose, use is customarily made of two different cylinder locks. Firstly, cylinder locks are known which permit the associated locking means, i.e. the key, to be removed in both positions, i.e. the off position and the on position, with respect to the locked switch. At the same time, however, it is crucial for use situations in which only a single electric switch should ever be switched on that the key can be removed only in the locked off position.

For this purpose, use is made of other cylinder locks which have to be fitted into the electric switches. The housing with corresponding locking grooves also has to be adapted to the respective embodiment of the cylinder lock.

In order therefore to vary between the described standalone solution with locking and unlocking and the key being able to be pulled out in any position (locking use) and a use situation in which the key can be pulled out only in the locked off position (interlocking use), different cylinder locks and different structural embodiments of the electric switches, in particular of the housings thereof, are necessary. This leads to increased costs and especially to different embodiments with reduced flexibility in respect of the use.

SUMMARY

At least one embodiment of the present invention at least partially eliminates at least one of the above-described disadvantages. In particular, in at least one embodiment of the present invention, a locking option for different locking requirements for different intended uses is permitted in a cost-effective and simple manner.

At least one embodiment is directed to a lock insert, a sales unit and/or a lock device. Further features and details of embodiments of the invention will emerge from the dependent claims, the description and the drawings. Features and details which are described in conjunction with the lock insert according to at least one embodiment of the invention self-evidently also apply in conjunction with the sales unit according to at least one embodiment of the invention and with the lock device according to at least one embodiment of the invention, and conversely in each case, such that, with regard to the disclosure, reference is, or can be, always made to the individual aspects of at least one embodiment of the invention reciprocally.

A lock insert according to at least one embodiment of the invention for a cylinder lock serves to lock an electric switch. For this purpose, the lock insert according to at least one embodiment of the invention has a main part with a receiving opening for receiving the cylinder lock. The inner wall here of the receiving opening is designed to contact an outer wall of the cylinder lock at least in sections, and, furthermore, at least one groove is formed in the inner wall to allow freedom of radial movement of locking elements of the cylinder lock. The position of the groove corresponds to a locked position of the cylinder lock.

An embodiment of the present invention likewise relates to a sales unit comprising at least two lock inserts according to an embodiment of the present invention. A sales unit according to an embodiment of the invention is distinguished in that at least two lock inserts differ in respect of the number of grooves in the inner wall of the respective receiving opening. The different use situations by different lock inserts are therefore reflected by a sales unit. Such sales units can thus be added to the electric switch during the sale such that during installation, the two different lock inserts are made available by the sales unit. In this installation situation, it is then possible to decide at the latest possible point which use functionality the switch is intended to obtain, by means of selection of the corresponding lock insert. By the use of lock inserts according to an embodiment of the invention, the same advantages as have been explained in detail with respect to a lock insert according to an embodiment of the invention are accordingly also achieved by a sales unit according to an embodiment of the invention.

At least one embodiment of the present invention furthermore relates to a lock device for locking an electric switch, comprising a lock insert according to an embodiment of the invention, a cylinder lock received in the receiving opening of the lock insert, and a bolt element. The bolt element is connected to the cylinder lock in such a manner that rotation of the cylinder lock produces rotation of the bolt element. The lock device is preferably inserted in a housing of an electric switch. In the process, the bolt element can engage in particular in an opening in a sheet metal part of the latch of the switch. The described locking operation and the described unlocking operation can therefore be achieved particularly cost-effectively and simply.

BRIEF DESCRIPTION OF THE DRAWINGS

Further advantages, features or details of the invention emerge from the description below in which example embodiments of the invention are described in detail with reference to the drawings. The features mentioned in the claims and in the description may be essential to the invention here in each case individually by themselves or in any combination. In the drawings, in schematic form:

DETAILED DESCRIPTION OF EXAMPLE EMBODIMENTS

Figure 1:
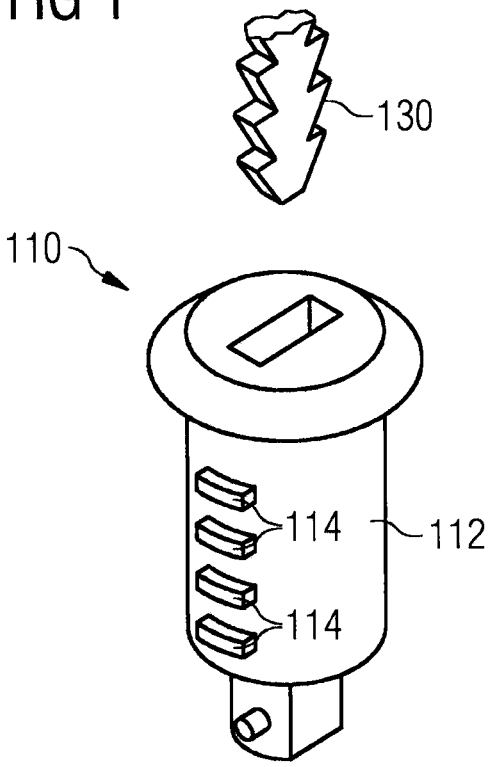
FIG. 1 shows an embodiment of a cylinder lock.

At least one embodiment is directed to a lock insert, a sales unit and/or a lock device. Further features and details of embodiments of the invention will emerge from the dependent claims, the description and the drawings. Features and details which are described in conjunction with the lock insert according to at least one embodiment of the invention self-evidently also apply in conjunction with the sales unit according to at least one embodiment of the invention and with the lock device according to at least one embodiment of the invention, and conversely in each case, such that, with regard to the disclosure, reference is, or can be, always made to the individual aspects of at least one embodiment of the invention reciprocally.

A lock insert according to at least one embodiment of the invention for a cylinder lock serves to lock an electric switch. For this purpose, the lock insert according to at least one embodiment of the invention has a main part with a receiving opening for receiving the cylinder lock. The inner wall here of the receiving opening is designed to contact an outer wall of the cylinder lock at least in sections, and, furthermore, at least one groove is formed in the inner wall to allow freedom of radial movement of locking elements of the cylinder lock. The position of the groove corresponds to a locked position of the cylinder lock.

Contrary to known solutions, according to at least one embodiment of the invention, the cylinder lock is no longer directly fitted into the housing of an electric switch. On the contrary, a lock insert according to at least one embodiment of the present invention is used, as it were, as a lock adapter for the cylinder lock. The lock insert has a receiving opening into which the cylinder lock can be inserted or pushed.

A cylinder lock is customarily of cylindrical design with respect to the main shape of extent thereof. The receiving opening corresponds to the shape and accordingly preferably has a substantially round cross-sectional opening. The receiving opening here is designed to contact the outer wall of the cylinder lock at least in sections. This means that the cylinder lock is accommodated in an enclosed manner in the receiving opening.

The inner wall of the receiving opening and the outer wall of the cylinder lock are thus in contact over the largest surface portions, and therefore the cylinder lock is defined unambiguously in respect of the relative position thereof. Further fastening means for axially securing the cylinder lock in the receiving opening can also be arranged both on the cylinder lock and within the receiving opening.

Furthermore, at least one groove is provided in the receiving opening, in the inner wall thereof. The groove extends axially or substantially axially along the longitudinal axis of the receiving opening or along the longitudinal axis of the cylinder lock. The manner of operation of the groove is explained in more detail below.

A cylinder lock is customarily designed in such a manner that radially arranged and moveable locking elements are provided. The structural and geometrical embodiment of the locking elements correlates with corresponding key bit formations of the key. If the key is inserted into the cylinder lock, the key displaces the locking elements radially by a distance which corresponds to the correlation between the respective locking element and the key bit situation of the key.

When a key fits, the radial displaceability results in all of the locking elements being aligned with the key in such a manner that the locking elements no longer protrude over the outer wall of the cylinder lock. In this situation with the key fully inserted, the outer wall is therefore the outermost boundary of the cylinder lock, and therefore there is rotational symmetry and, accordingly, rotation of the cylinder lock can take place.

If the key does not fit or if the key is pulled out, the individual locking elements are not situated entirely radially within the cylinder lock, but rather protrude over the outer wall. In the locking position, the locking elements can engage in the groove in the inner wall, and therefore rotation of the cylinder lock is avoided. The rotation of the cylinder lock corresponds to the locking or the unlocking of the electric switch.

As can be seen from the above explanation, the correlation between the locking elements of the cylinder lock and the groove of the receiving opening is crucial. In order to pull the key out of the cylinder lock, the cylinder lock has to be in a position in which, when the key is pulled out over the outer wall, the locking elements can move radially outward. This is the case only in a position of the cylinder lock, in which there is a corresponding correlation between the locking elements and an associated groove in the inner wall of the receiving opening.

If the electric switch is now used in the locking use system described, the key can be pulled out in both closing positions (locking and unlocking). For this purpose, two grooves are provided in the lock insert, in the inner wall of the receiving opening, the grooves corresponding to the two locked positions (locking and unlocking) of the cylinder lock. The key can therefore be pulled out both in the locked position and in the unlocked position.

If the electric switch is used for the interlocking use described, the key can only be pulled out in the locked position of the cylinder lock. In order to ensure this, only a single groove is formed in the inner wall of the receiving opening of the lock insert, the groove corresponding to the locked position of the cylinder lock. If the key is inserted and, accordingly, all of the locking elements are oriented within the outer wall, free rotation of the cylinder lock between the locked position and the unlocked position can take place.

However, in the unlocked position, in which the electric switch is freely movable, there is no groove in the inner wall of the receiving opening, in correlation with the locking elements. Accordingly, in the unlocked position, the key cannot be pulled out either since the locking elements are not movable radially outward over the outer walls. Only when the cylinder lock is rotated into the locked position is it possible to pull out the key since there is now the described correspondence with a groove in the inner wall of the receiving opening. When the key is pulled out, the locking elements can now pass radially outward since the necessary clearance is formed by the corresponding groove in the inner wall of the receiving opening.

It is clear from the above description that the differences between the two use situations (locking use and interlocking use) is ensured exclusively by different functionalities of the lock insert. It is thus possible for a standard cylinder lock and a standard of the electric switch to be provided in order to bring about the two different use situations described.

The differences in complexity therefore focus on a lock insert which is cost-effective and is especially simple to produce. This has the effect that different variants of the electric switch and different variants of the cylinder lock are no longer necessary. Costs and complexity are therefore reduced.

Depending on the intended use, a decision can even be delayed until at the building site as to which use situation the electric switch and the cylinder lock are intended to be configured for, by choosing the appropriate lock insert in the respective use situation. Retrospectively changing already installed electric switches in respect of the use functionality thereof is also possible by interchanging the lock insert.

The flexibility is therefore improved even further by the universal usability of lockable electric switches.

Of course, separate components can be provided for the locking operation. The cylinder lock can have, for example, additional bolt elements which, for example, can engage in sheet metal components of the latch of the electric switch. It may be of advantage for this purpose if the receiving opening does not have a base and does not have a base surface, but rather is designed as a through opening.

It may be of advantage if, in the case of a lock insert according to an embodiment of the invention, anti-twist protection for securing the main part against twisting relative to a housing of the switch is arranged on the outer side of the main part. The anti-twist protection can be, for example, a radial extent or a radial groove which corresponds with the corresponding geometrical correlations of the housing. The anti-twist protection therefore defines the rotatory position of the main part of the lock insert with respect to the housing. Therefore, rotation of the main part during the rotation of the cylinder lock is avoided with a high degree of certainty.

Interference fits within the housing or frictional connections can also serve for such anti-twist protection. Upon rotation of the key in order to rotate the cylinder lock and the associated variation between the locked position and the unlocked position, the necessary correlation with the grooves within the inner wall of the receiving opening is therefore maintained by the anti-twist protection of the lock insert. The anti-twist protection can be arranged here visibly or else can be concealed by the housing. For example, it is of advantage if such anti-twist protection is coupled to a mechanical fastening interface or is formed together with such a fastening interface.

It may likewise be of advantage if, in the case of a lock insert according to an embodiment of the invention, the main part has a mechanical fastening interface for the fastening to a housing of the electric switch. The mechanical fastening interface is designed in particular for tool-free installation. For example, snap-type latching devices can be provided as the mechanical fastening interface. The lock insert can therefore be fastened to the housing against rotation axially and preferably also in the circumferential direction. The fastening takes place, for example, reversibly. However, in order to prevent a retrospective variation or changes to the intended purpose, a mechanical fastening interface which permits an irreversible fastening to the housing of the electric switch may be preferred for safety reasons.

It is likewise advantageous if, in the case of a lock insert according to an embodiment of the invention, at least two grooves are formed in the inner wall, the position of which grooves corresponds in each case to a locked position of the cylinder lock. The first locked position therefore serves to lock the switch. The second locked position which is in particular an unlocked position corresponds to the unlocking of the switch. A differentiation can therefore be made between an embodiment of the lock insert with precisely one groove for the described interlocking intended use.

On the other hand, with precisely two or else more grooves for a plurality of switching and locking situations, the described use functionality for the locking use can be provided. Accordingly, by way of this embodiment of the at least two grooves, preferably with precisely two grooves, the locking functionality of the entire system consisting of cylinder lock, lock insert and electric switch can be ensured.

A further advantage is achieved if, in the case of a lock insert according to an embodiment of the invention, the main body is at least partially formed from plastic, in particular from an injection molding material. This results in lock inserts according to an embodiment of the invention being able to be produced particularly cost-effectively. Since the differentiation between the different intended uses is formed solely by the lock insert, the reduction in the number of pieces necessary in respect of the necessary flexibility can now be provided particularly cost-effectively. The weight of the main part is thereby also significantly reduced. The material, i.e. the plastic, is preferably designed in such a manner that an electric insulating effect is provided. It is therefore ensured that a voltage flashover when the cylinder lock is used is particularly advantageously and effectively avoided.

It may likewise be of advantage if, in the case of a lock insert according to an embodiment of the invention, markings of the possible locked positions are arranged on the main part in a visible section which is visible in the installation position. In particular, the marking of the locked position and of the unlocked position is involved here. The different locked positions can therefore be displayed in a particularly simple manner for easier operability of the electric switch and of the cylinder lock. The number of grooves and the correlation or position thereof are advantageously also arranged on such a visible section. The marking here can have, for example, symbolic characters. Imprints or else stick-on labels are possible. However, depressions or elevations are also conceivable as markings within the meaning of an embodiment of the present invention.

An embodiment of the present invention likewise relates to a sales unit comprising at least two lock inserts according to an embodiment of the present invention. A sales unit according to an embodiment of the invention is distinguished in that at least two lock inserts differ in respect of the number of grooves in the inner wall of the respective receiving opening. The different use situations by different lock inserts are therefore reflected by a sales unit. Such sales units can thus be added to the electric switch during the sale such that during installation, the two different lock inserts are made available by the sales unit. In this installation situation, it is then possible to decide at the latest possible point which use functionality the switch is intended to obtain, by way of selection of the corresponding lock insert. By the use of lock inserts according to an embodiment of the invention, the same advantages as have been explained in detail with respect to a lock insert according to an embodiment of the invention are accordingly also achieved by a sales unit according to an embodiment of the invention.

It is likewise of advantage if the sales unit according to the above paragraph connects the lock inserts releasably to one another, in particular via a severable material bridge. For example, the sales unit can thus be manufactured as an integrally formed injection molded part. The lock insert which is necessary and is to be used in each case can be selected by tearing or severing along a predetermined breaking point or a predetermined breaking line. A sales unit according to an embodiment of the present invention that is particularly cost-effective and is especially simple to use is involved here.

At least one embodiment of the present invention furthermore relates to a lock device for locking an electric switch, comprising a lock insert according to an embodiment of the invention, a cylinder lock received in the receiving opening of the lock insert, and a bolt element. The bolt element is connected to the cylinder lock in such a manner that rotation of the cylinder lock produces rotation of the bolt element. The lock device is preferably inserted in a housing of an electric switch. In the process, the bolt element can engage in particular in an opening in a sheet metal part of the latch of the switch. The described locking operation and the described unlocking operation can therefore be achieved particularly cost-effectively and simply.

A lock device according to an embodiment of the invention can be developed to the effect that the cylinder lock has locking elements which lock the rotation of the cylinder lock when the locking elements are moved radially outward into the at least one groove in the inner wall of the receiving opening. The already described correlation with the capability of pulling out the key is therefore ensured. The described locking operation also becomes effective in the event of an entry, passing radially outward, into the groove. The pull-out protection in a position in which the locking elements do not correlate with the groove is thereby also ensured for the key in a cost-effective and simple manner.

FIG. 1 shows a first embodiment of a cylinder lock 110. The latter is lockable with a key 130. The key 130 is pushed for this purpose into an associated groove in the cylinder lock 110 and, on being pushed in, correlates with corresponding locking elements 114.

Figure 2:
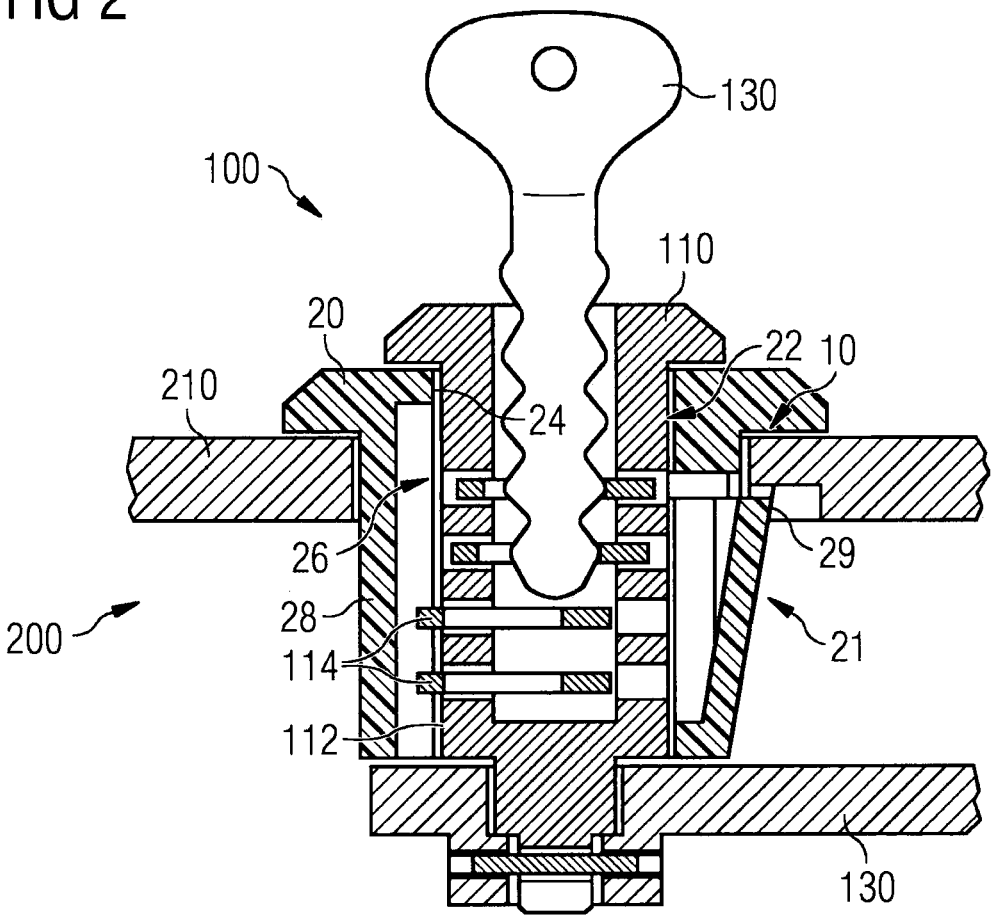
FIG. 2 shows an embodiment of a lock device according to the invention.

FIG. 2 readily shows the correlation between the key 130 and the locking element 114 in cross section. In the event of a fitting key 130, the key bit introduced has the effect that the locking elements 114 are aligned around the key 130, as is already the case with the two upper locking elements 114. This alignment of the locking elements 114 takes place to the effect that the locking elements recede entirely behind the outer wall 112 of the cylinder lock 110. When the key 130 is pulled out, the correlation is cancelled again and therefore the locking elements 114 can pass beyond the outer wall 112 and can accordingly enter an associated groove 26.

FIG. 2 is an embodiment of a lock device 100 according to the invention. The lock device is formed with a lock insert 10 which has a main part 20. A receiving opening 22 is provided in the main part 20. A snap-type latching connection to the housing 210 of the electric switch 200 takes place via a mechanical fastening interface 21. At the same time, the anti-twist protection 29 of the main part 20 relative to the housing 210 is also ensured via the mechanical interface 21. The anti-twist protection 29 and also the mechanical fastening interface 21 are formed on the outer side 28 of the main part 20.

Furthermore, it can be gathered from FIG. 2 that at least one groove 26, into which the locking elements 114 can enter, as FIG. 2 shows, is formed in the receiving opening 22.

If the key 130 is inserted and the cylinder lock 110 is rotated into a position as FIG. 2 shows, the key 130 can be pushed in and can be pulled out here since there is a corresponding groove 26. If, after the insertion of the key 130, rotation of the cylinder lock 110 is carried out, wherein, in the end position, a groove 26 no longer correlates with the locking elements 114, the key 130 cannot be pulled out either since the individual locking elements 114 can no longer enter radially outward into an associated groove 26. Precisely one or precisely two grooves 26 is or are preferably provided in the lock insert 10.

Figure 3:
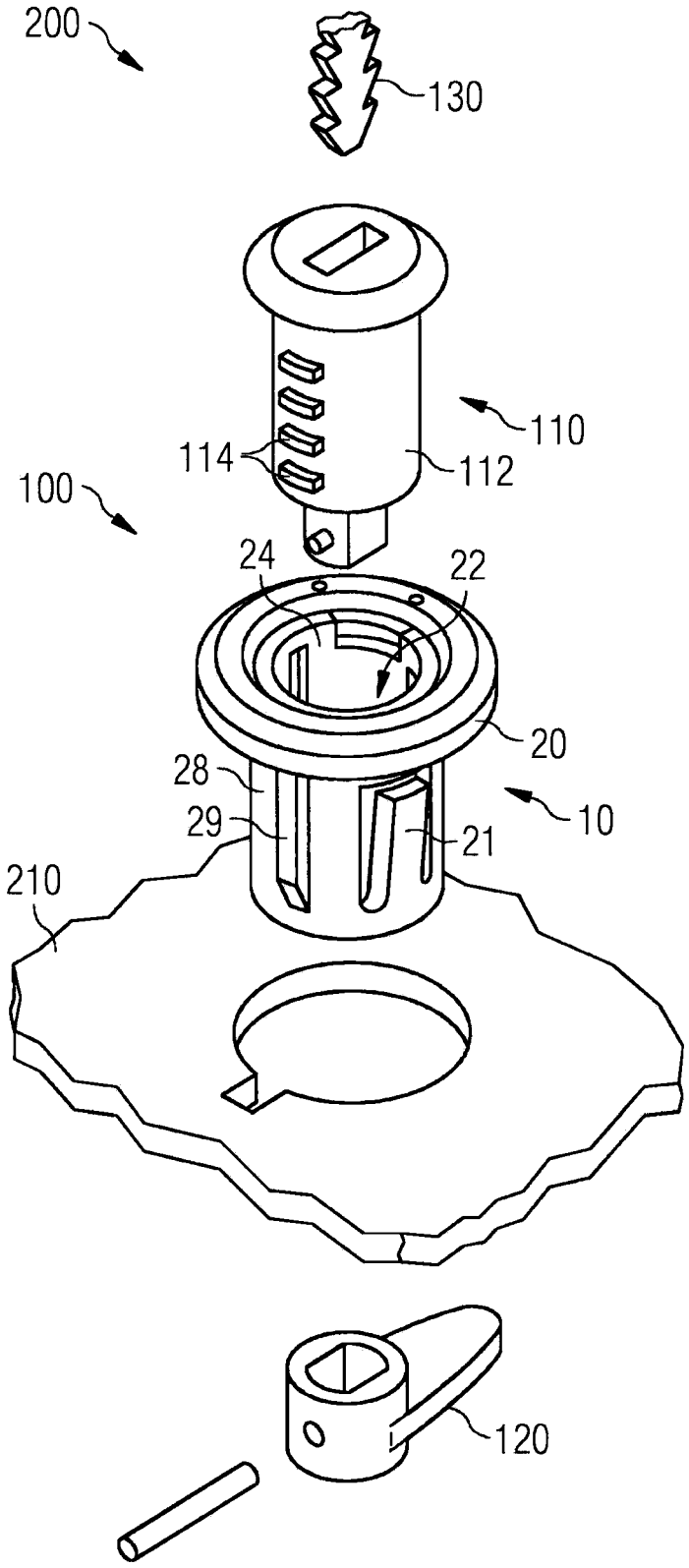
FIG. 3 shows the embodiment of FIG. 2 in an exploded illustration.

The correlation and also the installation situation are readily illustrated in an exploded illustration in FIG. 3. Moreover, the bolt element 120, which is fastened at the axially opposite end of the cylinder lock 110 to the key 130, can readily be seen here. Via a rotationally fixed connection, locking or unlocking can now be made possible by the bolt element 120 engaging on or disengaging from an associated latch of the electric switch 200.

Figure 4:
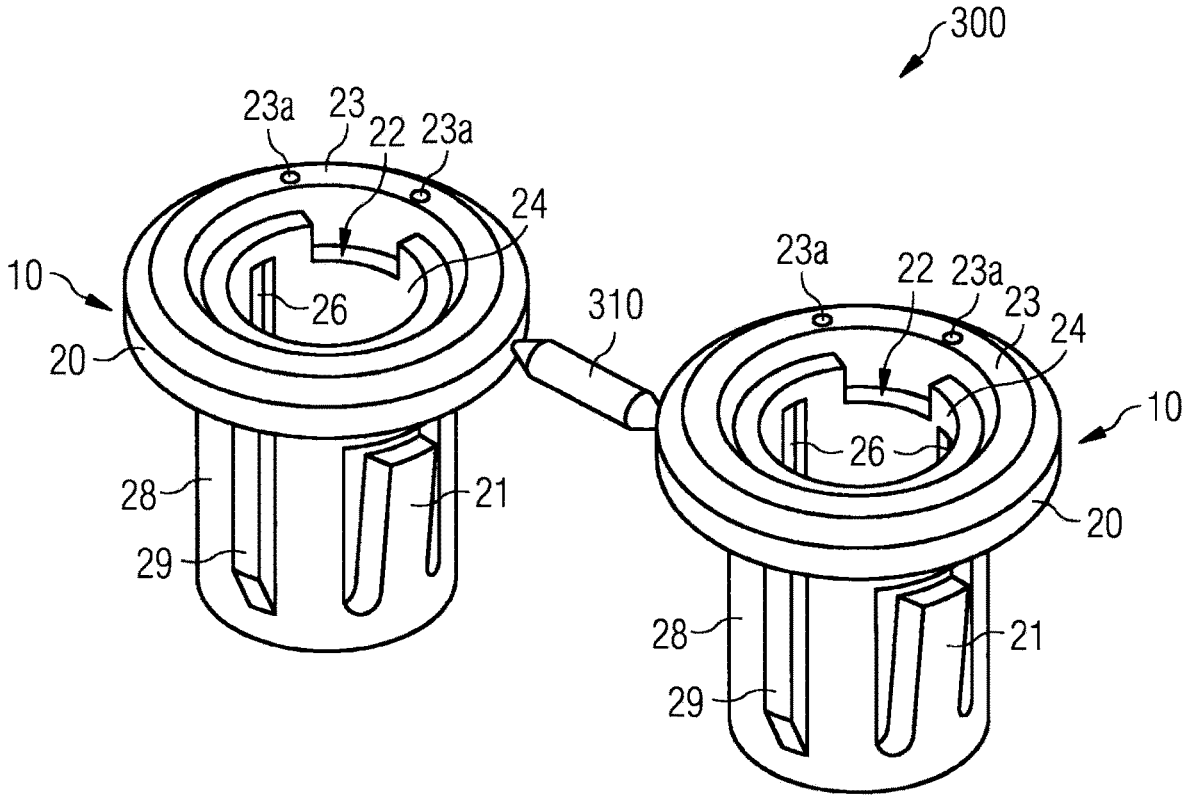
FIG. 4 shows an embodiment of a sales unit according to the invention.

FIG. 4 shows an embodiment of a sales unit 300 which has two lock inserts 10. The two lock inserts 10 differ in that the left lock insert has only a single groove 26 and the right lock insert 10 has two grooves 26. The different use functionalities are thereby provided within the sales unit 300. Depending on which functionality is desired, the material bridge 310 can be severed and use made of the lock insert 10 to be inserted correspondingly. The markings 23*a* which correlate with the respective groove positions of the grooves 26 and therefore with the locked position and the unlocked position can also be readily seen here in the visible section 23.

The above explanation of the embodiments describes the present invention exclusively within the scope of examples. Of course, individual features of the embodiments can be freely combined with one another, if technically feasible, without departing from the scope of the present invention.

REFERENCE NUMBERS

10 Lock insert
20 Main part
21 Mechanical fastening interface
22 Receiving opening
23 Visible section
23*a* Marking
24 Inner wall
26 Groove
28 Outer side of the main part
29 Anti-twist protection
100 Lock device
110 Cylinder lock
112 Outer wall
114 Locking element
120 Bolt element
130 Key
200 Electric switch
210 Housing
300 Sales unit
310 Material bridge

The invention claimed is:

1. A lock insert for a cylinder lock for locking an electric switch, comprising:

a main part including a receiving opening for receiving the cylinder lock, an inner wall of the receiving opening being designed to contact an outer wall of the cylinder lock at least in sections, at least one groove being formed in the inner wall to allow freedom of radial movement of locking elements of the cylinder lock, and a position of the at least one groove corresponding to a locked position of the cylinder lock, and a remainder of the inner wall corresponding to a key retention position of the locking elements.

2. The lock insert of claim 1, wherein anti-twist protection for securing the main part against twisting relative to a housing of the switch is arranged on an outer side of the main part.

3. The lock insert of claim 1, wherein the main part includes a mechanical fastening interface for the fastening to a housing of the electric switch.

4. The lock insert of claim 1, wherein the at least one groove includes at least two grooves, formed in the inner wall, the position of each of the at least two grooves corresponding to a locked position of the cylinder lock.

5. The lock insert of claim 1, wherein the main part is at least partially formed from plastic, in particular from an injection molding material.

6. The lock insert of claim 1, wherein markings of possible locked positions are arranged on the main part in a section visible in the installation position.

7. A sales unit, comprising:

at least two of the lock inserts of claim 1, wherein the at least two lock inserts differ in respect of a number of the at least one groove in the inner wall of the respective receiving opening.

8. The sales unit of claim 7, wherein the lock inserts are connected releasably to one another.

9. A lock device for locking an electric switch, comprising:

the lock insert of claim 1;

a cylinder lock, received in the receiving opening of the lock insert; and a bolt element, connected to the cylinder lock such that rotation of the cylinder lock produces rotation of the bolt element.

10. The lock device of claim 9, wherein the cylinder lock includes locking elements which lock the rotation of the cylinder lock when the locking elements are moved radially outward into the at least one groove in the inner wall of the receiving opening.

11. The lock insert of claim 2, wherein the main part includes a mechanical fastening interface for the fastening to a housing of the electric switch.

12. The lock insert of claim 2, wherein the at least one groove includes at least two slots, formed in the inner wall, the position of each of the at least two slots corresponding to a locked position of the cylinder lock.

13. The lock insert of claim 2, wherein the main part is at least partially formed from plastic from an injection molding material.

14. The lock insert of claim 2, wherein markings of possible locked positions are arranged on the main part in a section visible in the installation position.

15. The sales unit of claim 8, wherein the lock inserts are connected releasably to one another via a severable material bridge.

16. A sales unit, comprising:

at least two of the lock inserts of claim 2, wherein the at least two lock inserts differ in respect of a number of the at least one groove in the inner wall of the respective receiving opening.

17. The sales unit of claim 16, wherein the lock inserts are connected releasably to one another.

18. The sales unit of claim 17, wherein the lock inserts are connected releasably to one another via a severable material bridge.

19. A lock device for locking an electric switch, comprising:

the lock insert of claim 2;

a cylinder lock, received in the receiving opening of the lock insert; and a bolt element, connected to the cylinder lock such that rotation of the cylinder lock produces rotation of the bolt element.

20. The lock device of claim 19, wherein the cylinder lock includes locking elements which lock the rotation of the cylinder lock when the locking elements are moved radially outward into the at least one groove in the inner wall of the receiving opening.

* * * * *